United States Patent [19]

Besson

[11] Patent Number: 4,837,755

[45] Date of Patent: Jun. 6, 1989

[54] DEVICE FOR CONTROLLING OR CORRECTING THE READOUT OF THE DAY OF THE WEEK OR DATE FOR A WRIST WATCH

[75] Inventor: René Besson, Geneve, Switzerland

[73] Assignee: Montres Rolex S.A., Geneve, Switzerland

[21] Appl. No.: 197,751

[22] Filed: May 23, 1988

[30] Foreign Application Priority Data

May 25, 1987 [CH] Switzerland ..... 02014/87

[51] Int. Cl.[4] ..... G04B 19/24

[52] U.S. Cl. ..... 368/35; 368/37; 368/38

[58] Field of Search ..... 368/28, 31, 32, 34, 368/35, 36, 37, 38

[56] References Cited

U.S. PATENT DOCUMENTS

| | | | |
|---|---|---|---|
| 3,413,800 | 12/1968 | DuBois et al. | 368/35 |
| 3,859,783 | 1/1975 | Wuthrich | 368/35 |
| 4,050,233 | 9/1977 | Ingewieur | 368/35 |
| 4,109,458 | 8/1978 | Suzuki et al. | 368/35 |
| 4,221,111 | 9/1980 | Onda et al. | 368/35 |
| 4,234,943 | 11/1980 | Teramoto et al. | 368/35 |
| 4,291,397 | 9/1981 | Wuthrich et al. | 368/35 |

*Primary Examiner*—Bernard Roskoski

*Attorney, Agent, or Firm*—Frost & Jacobs

[57] ABSTRACT

A device for controlling or correcting the readout of the day of the week or date for an analog watch, comprising a crown cogged on the inside and integral with a date or day disk, a bi-directional drive motor and a drive wheel coupled to the drive motor, the drive wheel having two opposite spring-loaded clicks and an arcuate slot in which a fixed stud is engaged, the stud cooperating with the edges of the slot to limit the travel of the drive wheel. The drive mechanism of the date or day disk can thus be recentered automatically after the watch has stopped while simultaneously compensating the rated steps of the motor.

13 Claims, 2 Drawing Sheets

DEVICE FOR CONTROLLING OR CORRECTING THE READOUT OF THE DAY OF THE WEEK OR DATE FOR A WRIST WATCH

BACKGROUND OF THE INVENTION

The present invention relates to a device for controlling or correcting the readout of the day of the week or of the date for a watch, particularly a wrist watch, comprising at least one bi-directional electric motor, at least one mechanism coupled to this motor to drive a day disk or a date disk and at least one electronic circuit designed to transmit control impulses to this motor.

In known wrist watches, of the analogue type, the change of date and of day of the week habitually occurs at 24 hours. This change occurs within a very short period of time, thanks to the release of energy which has been accumulated by a suitable mechanism over a longer or shorter period of time. If the user changes time zone, in the sense of local time being behind the local time of the site of origin, and if he moves the needles backwards roughly at midnight, the correction of the day and of the date can not be made at the same time as the correction of the hour. In these conditions, the information regarding day and date displayed on the watch are incorrect for at least a part of the time separating the moment when the operation was carried out and midnight at the new geographical site. This constitutes a drawback. The object of the present invention is to find a solution to this drawback whilst avoiding making concessions on other matters, such as, for example, the supression of the instantaneous nature of the change of date and/or of the day of the week.

Once the instantaneity of the change and the symmetry of passing from one day of the week and/or one date to another at midnight have been achieved, the object of the invention is also to guarantee, in an almost absolute way, the reliability of the readout of the day and of the date. This reliability implies safety against shocks, safety against the rated steps of the drive motor(s), of day and/or date disks(s) and an automatic starting-up of the drive mechanism of these disks after the watch has stopped or the battery has been changed. With regard to this last point, on certain watches, if the readout of the day or date appears offset or incomplete in the corresponding window after changing the battery, the displacement has repercussions from day to day because no automatic means for making the necessary correction is provided.

The control or correction device in accordance with the invention is designed to resolve all these problems and to remove all the drawbacks of known systems for displaying the day and/or the date on a wrist watch. It is proposed to allow the day and/or the date to be displayed in a precise way in all conditions of use and irrespective of the time zone, and in particular to enable the change of day and date in the two directions within a very short period of time.

SUMMARY OF THE INVENTION

This object is achieved by the device according to the invention characterised in that the mechanism comprises a device coupled to the said motor and pivoting around a fixed axis, symmetrically in one direction or the other with respect to a central position, towards two extreme positions, this device comprising an element likely to be coupled to the day disk or to the date disk so as to drive it by one step in one direction or the other, so as to modify the readout of the day or of the date by increasing or decreasing it.

According to a preferred embodiment, the pivoting device is a wheel joined to stops intended to limit the amplitude of its pivoting in one direction or the other with respect to the central position, and the element likely to be coupled to the day or date disk is formed by two sprung clicks designed to drive this wheel in one direction or the other respectively.

The stops are preferably formed by the extreme edges of an arc-shaped slot provided concentrially in this wheel, and a fixed stud is engaged in this slot.

According to an advantageous refinement, the pivoting angle of the wheel, on both sides of its central position, is defined by the half-length of the arc formed by the slot provided in this wheel.

The two clicks preferably occupy a symmetrical position with respect to the diameter of the wheel passing through the middle of the arc-shaped slot.

The device advantageously comprises an indexing pawl for indexing the date or day disk in a traditional way.

Moreover the two sprung clicks preferably comprise one nose each designed to cooperate with the drive cogs of the day or date disk, these noses being disposed on the trajectory of the said cogs so as to form stops for the periods when this disk is at rest.

To modify the readout of the day or date, the electronic circuit is advantageously designed to transmit to the electric motor $N+n$ impulses of a first sign, then N impulses of the opposite sign to produce the displacement of the day or date disk in one direction or in the opposite direction, N being the number of impulses necessary to turn the pivoting device from its central position towards one of its extreme positions or to return it from one of its extreme positions into its central position, and n being a predetermined number of impulses in reserve intended to compensate the rated steps of the motor. The number of impulses n preferably lies between 1 and 20% of the number of impulses N.

To recentre automatically the drive mechanism of the day and date disk after the watch has stopped or after changing the battery, the electronic circuit is preferably designed to transmit to the electric motor a determined number of impulses of a first sign, then at least a determined number of impulses of the opposite sign, so as to turn the pivoting device from any, possibly off-centre, position into at least one of its extreme positions, and from this extreme position into its central position.

According to an advantageous refinement, the electronic circuit is designed to transmit to the electric motor N impulses of a first sign, then 2N impulses of the opposite sign, then N impulses of the first sign, N being the number of impulses necessary to turn the pivoting device from its central position towards one or the other of its extreme positions or from one of its extreme positions towards its central position.

According to another advantageous refinement, the electronic circuit is designed to transmit to the electric motor 2N impulses of a first sign, then N impulses of the opposite sign, N being the number of impulses necessary to turn the pivoting device from its central position towards one of its extreme positions or from one of its extreme positions towards its central position.

BRIEF DESCRIPTION OF THE DRAWING

The present invention will be better understood with reference to the description of an exemplified embodiment and of the attached drawing in which.

DETAILED DESCRIPTION OF THE INVENTION

Figure 1:
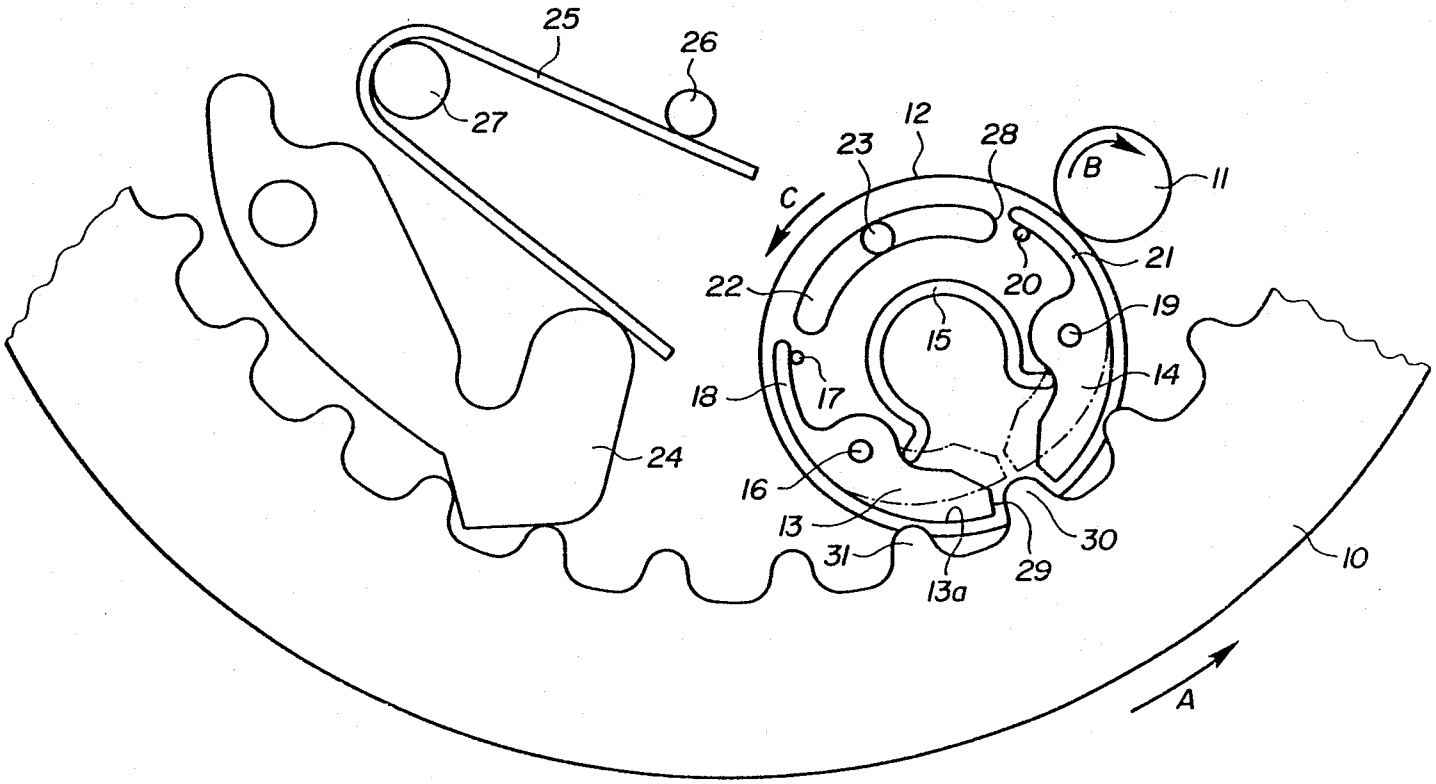
FIG. 1 shows a diagrammatic view of a preferred embodiment of the drive mechanism of the date disk of the device according to the invention.

With reference to FIG. 1, the drive mechanism of the date disk essentially comprises a crown 10 cogged on the inside, integral with the date disk (not shown), a bidirectional drive motor 11 and a drive wheel 12 coupled to the drive motor 11. The drive wheel 12 bears two opposite clicks 13 and 14 pulled towards their position shown by continuous lines, by a central spring 15. The click 13 may pivot around an axis 16, but the extent of this pivoting is limited by the presence of a fixed stop 17 against which (in the position shown by the figure) is supported a tip 18 extending click 13 past its pivoting axis 16. Similarly, click 14 can pivot around an axis 19, but the extent of this pivoting is limited by the presence of a fixed stop 20 against which (in the position shown by the figure) is supported a tip 21 extending click 14 past its pivoting axis 19. The wheel 12 also comprises a slot 22 having the shape of an arc concentric to the wheel, and in which is engaged a fixed stud 23 integral with a fixed part of the watch. This fixed stud 23 is intended to cooperate with the extreme edges of the slot to limit the travel of the drive wheel 12 when it is driven in rotation by the drive motor 11.

A pawl 24, pulled by a thrust spring 25 kept in place by two fixed stops 26 and 27, is designed to engage between the cogs of the crown 10 and to index precisely the date disk.

In normal operation, to advance the crown 10 by one step in the direction of arrow A, the electronic control (not shown) of the watch must impart to the drive motor 11 N impulses intended to turn it in the direction of arrow B. The result of this rotation is to turn the drive wheel 12 in the direction of arrow C, until the moment when the edge 28 of the slot 22 abuts against the fixed stud 23. The drive wheel 12 drives the two clicks 13 and 14. The nose 29 of click 13, thrust into the position shown by continuous lines on the Figure by central spring 15, abuts against the left-hand edge (on the figure) of cog 30 of the crown 10, which thereby is driven in the direction of arrow A. Click 14 remains in the position shown by continuous lines on the figure and turns simultaneously with the drive wheel 12 and the cogged crown 10.

Generally speaking, by positive impulses is implied a series of impulses which makes the motor advance by one step, and by necgative impulses is implied a series of impulses which makes the motor move back by one step.

As the return movement consists in bringing the drive disk 12 back into its initial position (shown by FIG. 1) in which the fixed stud 23 is disposed in the middle of slot 22, the electronic control of the device imparts to the drive motor 11 N impulses intended to turn it in the direction opposite to that of arrow B. The result of this rotation is to turn drive wheel 12 in the direction opposite to that of arrow C until the fixed stud 23 is back in the central position defined above. During this return, the rounded back **13*a* of click 13 slides along the top of cog 31 which in reality occupies the position of cog 30 as shown on FIG. 1 until the moment when the nose 29 of this click passes beyond this cog and until the click 13, pulled by spring 15, pivots around its axis 16 to return to its initial position. During this return operation click 14 did not perform any relative displacement with respect to disk 12**.

If, to correct the position of the date disk, the user wishes to move the cogged crown 10 in the direction opposite to that of arrow A, by means of the device for controlling a "date correction" function, he controls the rotation of motor 11 in the direction opposite to that of arrow B. In this case the corresponding rotation of disk 12 makes click 14 work in a manner completely identical to that described above. N impulses of a first sign produce the movement of the cogged crown 10 by one step and N impulses of the opposite sign imparted by the electronics of the watch to motor 11 normally produce the return of the drive mechanism of the date disk into its initial centred position.

Figure 2:
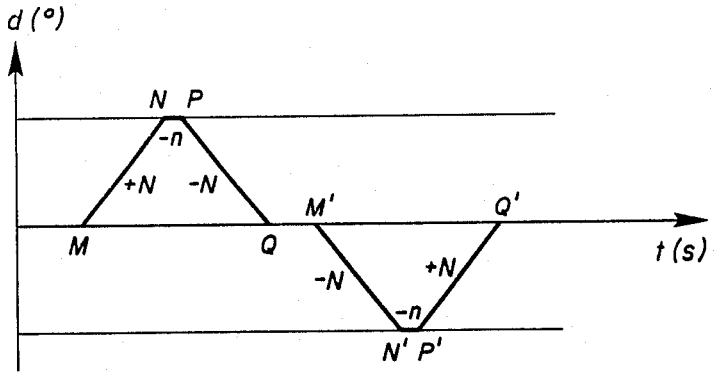
FIG. 2 shows a diagram illustrating the normal operation of the device according to the invention.

In practice, the electronics impart to the motor N+n impulses of a first sign and of the opposite sign to produce the movement of the cogged crown 10 by one step then the return of the drive mechanism into its centred position. The additional n impulses form a reserve of impulses in the order of 1 to 20% of the number of N impulses, guaranteeing a reliable operation of the mechanism. When everything is normal, N impulses are sufficient to produce the desired movement of the drive wheel 12, and the additional n impulses, during which the motor slips because one of the ends of the slot 22 abuts against stud 23, are lost. This operation is illustrated by the diagram of FIG. 2 in which the time in seconds is shown on the x axis and the movement in degrees is shown on the y axis.

Figure 3:
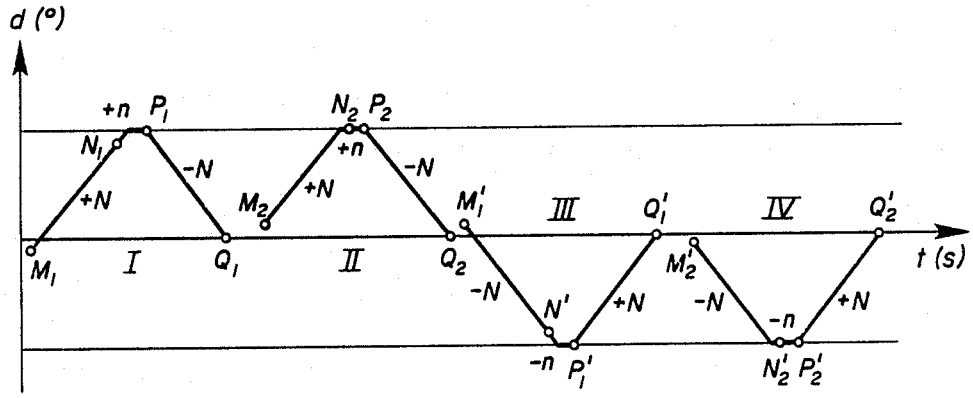
FIG. 3 shows a diagram illustrating the operation of the device according to the invention, in particular to compensate the rated steps of the motor.

When everything is normal, the mechanism comprising the wheel 12 and the sprung clicks 13 and 14 is initially centred, i.e. the stud 23 is located in the middle of slot 22. The segment MN corresponds to +N impulses transmitted to the motor, which has the effect of turning wheel 12 so as to bring the left-hand edge of this slot to abut against stud 23. The horizontal segment NP corresponds to +n impulses in reserve transmitted to the motor and which have the effect of pulling the wheel 12 in the same direction as that imparted by the preceding +N impulses. However in this case these impulses have no effect as the wheel has already reached its maximum pivoting point. The segment PQ corresponds to −N impulses transmitted to the motor, which have the effect of pivoting the wheel 12 so as to recentre it. Similarly, the segment M'N' corresponds to −N impulses transmitted to the motor, which have the effect of turning wheel 12 in the opposite direction, i.e. to bring the right-hand edge of the slot to abut against stud 23. The −n impulses in reserve are lost, given that the extreme position of the wheel could have already been reached by the preceding −N impulses. These −n impulses correspond to the segment N'P'. The last segment P'Q' corresponds to the return of the wheel into its centred position and to the transmission of +N impulses to the motor. If for any reason the wheel 12 is not centred at the start of an operating cycle, the four following cases illustrated by FIG. 3 can arise.

The first case is shown by curve I. The wheel, for example, is slightly displaced towards the left (direction of arrow C on FIG. 1) with respect to its centred position. The segment $M_1N_1$ represents the +N impulses theoretically necessary to bring the left-hand edge of the slot to abut against the stud 23. As the wheel is decentred, the path to be taken to reach the abutting position is longer than normal, with the result that, after the transmission of these +N impulses, the said abutting position has not yet been reached. This position can be reached thanks to +n impulses in reserve, one part of which, in the case of the figure, is adequate to correct the error. The remaining part of these +n impulses is lost, the wheel is stopped and the motor slips. For the return illustrated by segment $P_1Q_1$, a number of −N impulses enables the wheel 12 to return to its centred position.

It is therefore noted that thanks to the n impulses in reserve, it is possible to correct automatically an initial displacement and to end in a centred position after at least one operating cycle. In effect it is obvious that if the displacement can not be corrected during a first operating cycle, this correction can be made during subsequent cycles, each cycle reducing the initial displacement.

This displacement can be attributed to the "rated steps" of the motor or any other cause such as shocks, etc. Measures, described below, are however taken to avoid shocks being likely to decentre the mechanism.

The case illustrated by curve II corresponds to an initial displacement of wheel 12 towards the right with respect to its centred position. The number of initial +N impulses is more than required to bring the wheel into a stopped position. A number of impulses lower than +N would be sufficient to displace the wheel. The excess impulses are in this case added to the +n impulses in reserve and are not used to pivot the wheel. The curve segment $M_2N_2$ corresponds to the impulses necessary to bring the wheel to stop (inclined part of the curve) and to the excess impulses (horizontal part of the curve) which make the motor slip. The horizontal segment $N_2P_2$ corresponds to +n impulses in reserve and segment $P_2Q_2$ corresponds to −N return impulses.

It is also noted in this case that the return enables the mechanism to be brought back to its centred position.

The two cases illustrated by curves III and IV are symmetrical to those of curves I and II. The curve segments $M'_1N'_1$, $N'_1P'_1$, $P'_1Q'_1$ correspond to a series of impulses −N−n+N transmitted to the motor, where −N is inadequate to bring the wheel to stop.

The curve segments $M'_2N'_2$, $N'_2P'_2$, $P'_2Q'_2$ correspond to a series of impulses −N−n+N, where −N is surplus to requirements for bringing the wheel to abut.

Consequently, in all cases the mechanism is selfcentring, which enables the rated steps of the motor to be efficiently compensated.

Figure 4:
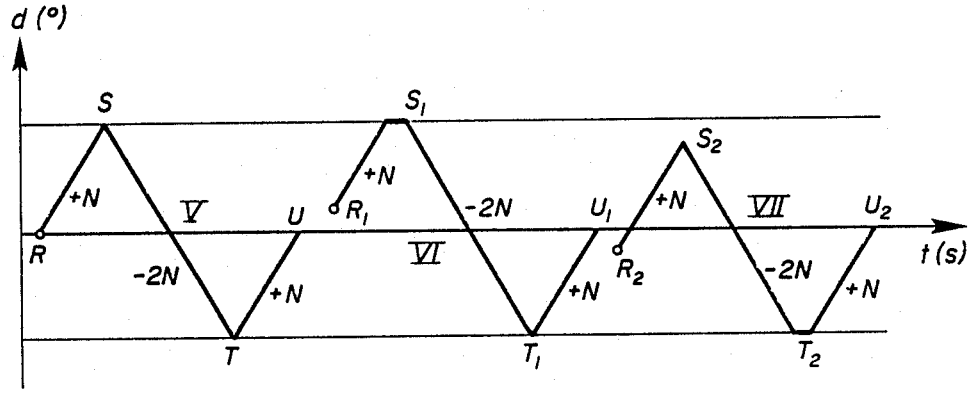
FIG. 4 shows a diagram illustrating the operation of the device according to the invention, in particular for recentring the drive mechanism of the day or date disk after the battery has been changed or after the watch has stopped.

FIG. 4 illustrates another advantage of this mechanism. It relates to an automatic starting-up of the day or date readout or, in other words, an automatic recentring of the drive mechanism of the corresponding disk. The drive of the day disk or date disk is a relatively large consumer of energy. Consequently, the end of the life of batteries habitually occurs at the moment when they are stressed the most. As a result, it may happen that the drive mechanism of the day or date disk is decentred at the moment when the battery is changed. In known watches, manual starting-up is required if it is wished to avoid the readout in the window being offset. The device according to the invention enables an automatic starting-up, which is translated into practice by a to-and-fro movement of the drive wheel 12. This programmed movement is illustrated by the three curves V, VI and VII of FIG. 4.

To effect this starting-up, a series of +N−2N+N or possibly −N+2N−N impulses is transmitted to the motor. If, as curve V shows, the wheel 12 is initially centred, the +N−2N+N series of impulses which feeds the motor ends in the same centred position as that which the wheel initially occupied. The segment RS corresponds to the movement of wheel 12 in the direction opposite to that of arrow C until the left-hand edge of slot 22 abuts against stud 23. The segment ST corresponds to the pivoting of the wheel 12 to bring the right-hand edge of the slot against stud 23. The segment TU corresponds to the pivoting of wheel 12 to bring it back into its centred position. The day or date disk has first turned in the opposite direction by one step.

If, as shown by the case illustrated by curve VI, wheel 12 is initially decentred in the direction opposite to that of arrow C, some of the +N impulses corresponding to segment $R_1S_1$ are surplus to requirements for bringing the left-hand edge of the slot to abut, with the result that the motor slips. Segment $S_1T_1$ corresponds to the −2N impulses bringing the right-hand edge of the slot to abut, and segment $T_1U_1$ corresponds to the +N impulses which recentre the wheel.

If, as shown by the case illustrated by curve VII, the wheel 12 is initially decentred in the direction of arrow C, the number of +N impulses corresponding to segment $R_2S_2$ is insufficient and does not enable the wheel to be brought to abut against the left-hand edge of the slot 22. Segment $S_2T_2$ corresponds to −2N impulses, which are not all required to bring the right-hand edge of the slot to abut. Segment $T_2U_2$ corresponds to +N impulses which recentre the wheel.

It is therefore noted that in all cases, including the two symmetrical cases in which the distribution of the impulses would be −N+2N−N, this starting-up phase enables the system to be recentred regardless of the position in which it is stopped. In practice, the control circuit is designed to detect the presence of a new battery and to produce a single series of recentring impulses. A circuit capable of restarting the operation could be designed for the case where a single to-and-fro movement would not be sufficient to recentre the system.

The system could also be recentred by transmitting to the motor series of impulses other than those defined above, for example those comprising: +2N−N or −2N+N impulses.

It will be noted that there is slight play between the noses of the two clicks and the cogs of crown 10 of the day or date wheel. This play is useful for enabling the indexing work of pawl 24. When at rest, the noses are located in the trajectory of said cogs, which enables them to act as stops preventing any accidental movement of the crown 10 and consequently of the day or date disk in the event of violent shocks.

The device has been described equally for the day indicator or the date indicator. The watches can have one, two or more identical mechanisms serving to indicate the days, dates, months of the year, etc, respectively.

The shape and dimensions of certain components could possibly be modified without departing from the principles and the definition of the present invention.

I claim:

1. Device for controlling or correcting the readout of the day or date for a watch, comprising at least one bi-directional electric motor, at least one mechanism coupled to said motor for driving one of a day disk and a date disk, and at least one electronic circuit designed to transmit control impulses to said motor, said mechanism comprising means coupled to said motor and pivoting around a fixed axis, symmetrically in one direction or another with respect to a central position, toward two extreme positions, said means comprising an element adapted to be coupled to one of said day disk and said date disk so as to drive it by one step in one direction or another, whereby to modify the readout of one of a day or of a date by increasing or decreasing it.

2. Device according to claim 1, wherein said pivoting means is a wheel having stops adapted to limit the amplitude of pivoting in one direction or another with respect to said central position, and wherein said element adapted to be coupled to one of said day disk and said date disk is formed by two spring-loaded clicks configured to drive said wheel in one direction or another, respectively.

3. Device according to claim 2, wherein said stops are formed by the extreme edges of an arcuate slot provided concentrically in said wheel, and wherein a fixed stud is engaged in said slot.

4. Device according to claim 3, wherein the pivoting angle of said wheel, on both sides of said central position, is defined by half the length of said arcuate slot.

5. Device according to claim 3, wherein said two clicks occupy a symmetrical position with respect to a diameter of said wheel passing through the middle of said arcuate slot.

6. Device according to claim 1, including an indexing pawl for indexing one of said day disk and said date disk.

7. Device according to claim 2, wherein said day disk and date disk are provided with drive cogs, wherein each of said clicks includes a nose designed to cooperate with said drive cogs, and wherein each said nose is disposed on the trajectory of said cogs so as to form stops for the periods when said disk is at rest.

8. Device according to claim 1, wherein, to modify the readout of the day or date, said electronic circuit is designed to transmit to said electric motor N+n impulses of a first sign, then N impulses of an opposite sign to produce displacement of one of said day disk and said date disk in one direction or in an opposite direction, N being the number of impulses necessary to turn said pivoting means from its central position toward one of its extreme positions, or to return it from one of its extreme positions into its central position, and n being a predetermined number of impulses in reserve intended to compensate the rated steps of said motor.

9. Device according to claim 8, wherein the number of impulses n lies between 1% and 20% of the number of impulses N.

10. Device according to claim 1, wherein said drive mechanism is recentered automatically after the watch has stopped or after changing the battery by said electronic circuit transmitting to said electric motor a determined number of impulses of a first sign, then at least a determined number of impulses of an opposite sign, so as to turn said pivoting means from any off-center position into at least one of said extreme positions, and from said extreme position into said central position.

11. Device according to claim 10, wherein said electronic circuit is designed to transmit to said electric motor N impulses of said first sign, then 2N impulses of said opposite sign, then N impulses of said first sign, N being the number of impulses necessary to turn the pivoting means from its central position toward one or the other of said extreme positions or from one of said extreme positions toward said central position.

12. Device according to claim 10, wherein said electronic circuit is designed to transmit to said electric motor 2N impulses of said first sign, then N impulses of said opposite sign, N being the number of impulses necessary to turn said pivoting means from said central position toward one of said extreme positions or from one of said extreme positions toward said central position.

13. Device according to claim 1, wherein said watch is a wrist watch.

* * * * *